US008503690B2

(12) United States Patent
Knieschewski

(10) Patent No.: US 8,503,690 B2
(45) Date of Patent: Aug. 6, 2013

(54) LOUDSPEAKER UNIT

(75) Inventor: Jorg Knieschewski, Garbsen (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 693 days.

(21) Appl. No.: 12/620,193

(22) Filed: Nov. 17, 2009

(65) Prior Publication Data

US 2010/0124340 A1 May 20, 2010

(30) Foreign Application Priority Data

Nov. 18, 2008 (DE) ..... 10 2008 058 028

(51) Int. Cl.

| | |
|---|---|
| ***H04R 1/025*** | (2006.01) |
| ***H04R 5/02*** | (2006.01) |
| ***H04R 1/26*** | (2006.01) |
| ***H04R 1/24*** | (2006.01) |
| ***H04R 1/02*** | (2006.01) |

(52) U.S. Cl.

CPC *H04R 1/025* (2013.01); *H04R 5/02* (2013.01); *H04R 1/26* (2013.01); *H04R 1/24* (2013.01)

USPC ..... 381/87; 381/332; 381/335; 381/182; 381/386

(58) Field of Classification Search

USPC ..... 381/87, 182, 386, 332, 335

See application file for complete search history.

(56) References Cited

U.S. PATENT DOCUMENTS

| | | | | |
|---|---|---|---|---|
| 5,143,339 | A | 9/1992 | Ashcraft et al. | |
| 5,193,119 | A | 3/1993 | Tontini et al. | |
| 5,513,270 | A * | 4/1996 | Lewis | 381/338 |
| 6,792,125 | B1 | 9/2004 | David et al. | |
| 2004/0190736 | A1 | 9/2004 | Gelow et al. | |
| 2005/0047604 | A1 | 3/2005 | Wright | |
| 2007/0127738 | A1 * | 6/2007 | Yamada et al. | 381/98 |
| 2007/0177755 | A1 * | 8/2007 | Kemmerer | 381/397 |

FOREIGN PATENT DOCUMENTS

| | | |
|---|---|---|
| DE | 10230409 C1 | 10/2003 |
| EP | 1827056 A | 8/2007 |

OTHER PUBLICATIONS

International Search/Examination Report dated Sep. 9, 2012 for the corresponding European patent application EP09175670.0.

* cited by examiner

*Primary Examiner* — Duc Nguyen
*Assistant Examiner* — George Monikang
(74) *Attorney, Agent, or Firm* — Kilpatrick Townsend & Stockton LLP

(57) ABSTRACT

There is provided a loudspeaker unit, in particular a ceiling loudspeaker unit, which has a housing (50) having a front housing portion (60). Arranged in the front housing portion (60) are a woofer unit (10), a baffle panel (70) and a tweeter unit (30) in a 2-way coaxial system. The tweeter unit (30) has a tweeter horn having a plurality of legs (33) and a plurality of openings (31) at the edge of the tweeter horn (30).

5 Claims, 5 Drawing Sheets

Sectional view

LOUDSPEAKER UNIT

CROSS-REFERENCE TO RELATED APPLICATIONS

Figure 1:
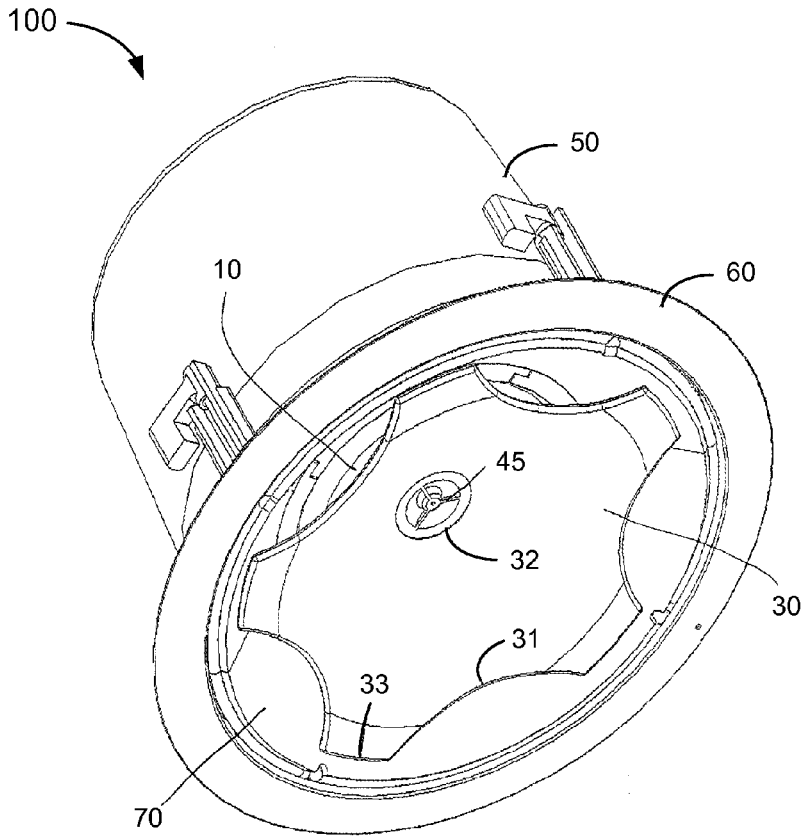

The present application claims priority to German Patent Application No. 10 2008 058 028.7, filed Nov. 18, 2008, the entire contents of which is herein incorporated by reference for all purposes.

The present invention concerns a loudspeaker unit, in particular a ceiling loudspeaker unit.

Ceiling loudspeakers are typically designed in the form of a 2-way coaxial system. A tweeter is provided on the same axis as a woofer in front of the woofer. Such loudspeakers however involve a relatively narrowly focused sound emission in the middle and treble range. The consequence of that can be that a sound impression, relative to the position of the listener, with respect to the position of the ceiling loudspeaker, can be perceived as different. A ceiling loudspeaker typically has a spread angle of 40-50°. Wider sound emission angles often lead to interference between tweeter and woofer, which can additionally worsen the sound impression.

DE 102 30 409 C1 shows a loudspeaker arrangement comprising a woofer loudspeaker and a tweeter loudspeaker which projects out of the loudspeaker arrangement.

An object of the present invention is to provide a loudspeaker unit having a 2-way system, which has a wider spread angle and in that respect reduces interference between the two loudspeaker systems.

That object is attained by a loudspeaker unit as set forth in claim 1.

Thus there is provided a loudspeaker unit, in particular a ceiling loudspeaker unit, having a housing with a front housing portion. Arranged in the front housing portion is a woofer unit, a baffle panel and a tweeter unit in a 2-way coaxial system. The tweeter unit has a plurality of legs and a plurality of openings at the edge of the tweeter unit.

In accordance with an aspect of the present invention the proportion of the areas of the openings with respect to a reference area is between 30% and 70% and in particular between 40% and 50%. The reference area is defined by an inside diameter and an outside diameter of the tweeter horn. The inside diameter is delimited by the depth of the openings and the outside diameter is delimited by the free-standing ends of the legs.

In a further aspect of the present invention the legs of the tweeter unit extend substantially to the edge of the baffle panel.

In accordance with a further aspect of the present invention the woofer unit is arranged sunk in the baffle panel.

The invention is based on the notion of arranging a tweeter unit in front of a woofer arranged in recessed relationship, the tweeter unit having openings at its edge.

The configurations of the openings or recesses at the edge of the tweeter unit means that the low-frequency woofer component of the woofer unit which is disposed behind the tweeter unit can be better radiated.

Further configurations of the invention are subject-matter of the appendant claims.

Advantages and embodiments by way of example of the invention are described in greater detail hereinafter with reference to the drawing.

Figure 2:
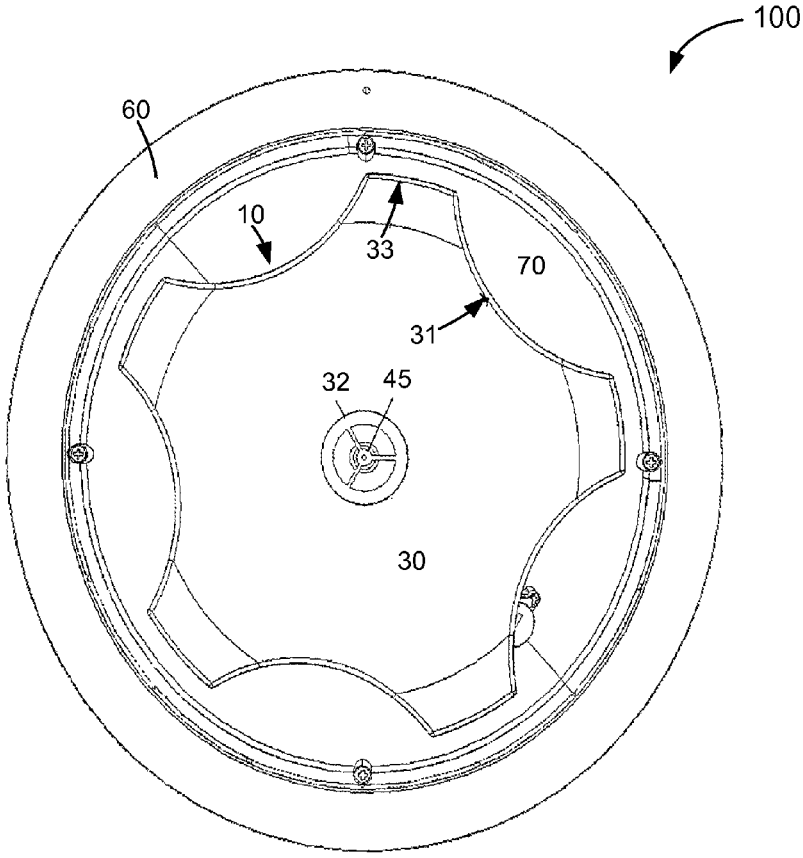
Figure 3:
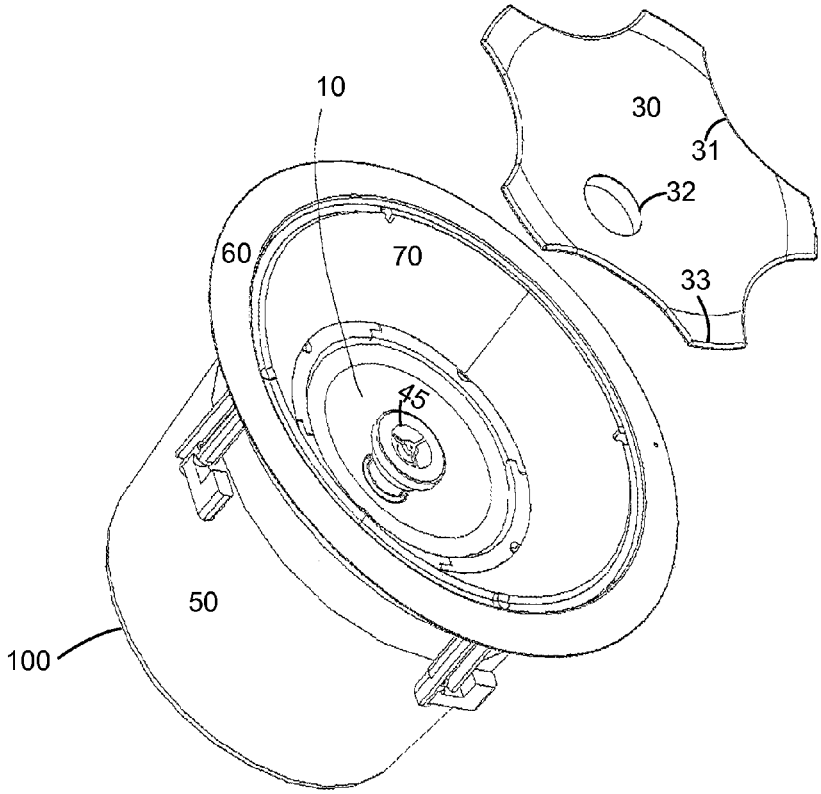
Figure 4:
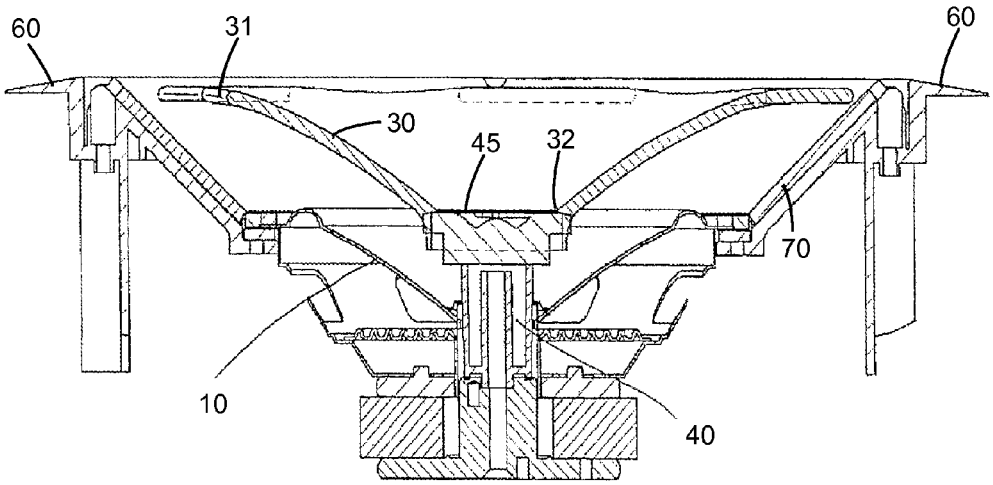
Figure 5:
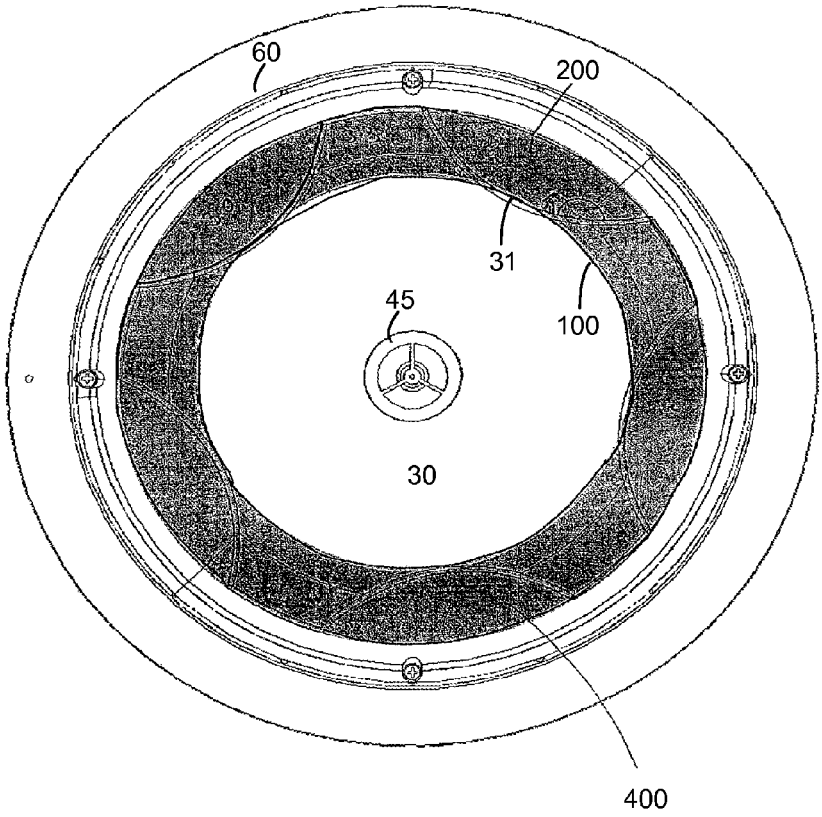

FIG. 1 shows a perspective view of a loudspeaker unit in accordance with a first embodiment, FIG. 2 shows a plan view of a loudspeaker unit in accordance with a first embodiment, FIG. 3 shows a perspective view of a loudspeaker unit according to the first embodiment, FIG. 4 shows a sectional view of a loudspeaker unit according to the first embodiment, and FIG. 5 shows a perspective view of a loudspeaker unit according to the first embodiment.

FIG. 1 shows a perspective view of a loudspeaker unit according to a first embodiment. The loudspeaker unit 100 has a front first housing portion 60 and a rearward housing 50 or second housing portion. The front first housing portion 60 has a woofer unit 10, a tweeter unit 30 and a baffle panel 70, wherein the woofer unit 10 and the tweeter unit 30 are designed in the form of a 2-way coaxial system. In this case the tweeter unit 30 is arranged axially in front of the woofer unit 10. Preferably the woofer unit 10 is arranged in a baffle panel 70 in displaced or sunk relationship. The tweeter unit 30 can also have a waveguide or a tweeter horn 30. Provided at the edge of the tweeter unit 30 or the tweeter horn are recesses, openings or holes 31. Legs 33 are provided between the openings 31. In the center the tweeter unit 30, 45 has a hole 32 into which the tweeter 45 can be inserted. The tweeter horn 30 is thus fixed to the tweeter 45. In this case the legs 33 are not fixed to the baffle panel 70 but extend freely in space.

The woofer unit 10 is substantially covered by the configuration of the tweeter unit 30. An exception in that respect is represented only by the openings 31 which permit the woofer unit 10 to radiate low frequencies substantially unimpededly.

That has the advantage that the mutual influencing between the woofer unit 10 and the tweeter unit 30 is very slight. Preferably the woofer unit 10 is provided in sunk relationship in the baffle panel 70. It should be pointed out that the sound of the woofer unit can escape or be radiated by way of the openings, recesses or holes at the edge of the tweeter unit.

Although FIG. 1 shows openings which are oval or in the form of a portion of a circle, the openings can also assume a different shape such as for example rectangular, triangular or the like.

The unit 40 represents a spacer unit with tweeter 45 fitted thereon, which unit can be fixed on the pole core of the woofer.

FIG. 2 shows a plan view of the loudspeaker unit of the first embodiment of FIG. 1. The loudspeaker unit 100 has a front first housing portion 60 of the housing, in which a woofer unit and a baffle wall 70 are accommodated. A tweeter unit 30 is held by means of the tweeter 45. The tweeter unit 30 has legs 33 as well as recesses or openings 31.

FIG. 3 shows a diagrammatic perspective view of the loudspeaker unit in the first embodiment. The loudspeaker unit 100 has a rear housing 50 and a front first housing portion 60. The front first housing portion 60 has a woofer unit 10 arranged in a baffle panel 70 in sunk relationship. A spacer unit 40 is provided in the center of the woofer unit 10 and serves to receive a tweeter unit 30, in which case the tweeter 45 can be received in a hole 32 of the tweeter unit 30. The tweeter unit 30 or the tweeter horn has legs 33 and openings or recesses 31.

FIG. 4 shows a sectional view of a loudspeaker unit in accordance with the first embodiment. The loudspeaker unit has a front first housing portion 60 with a baffle panel 70 and a woofer unit 10 arranged in recessed relationship. Provided in the center of the woofer unit 10 is a spacer unit 40 which can receive a tweeter unit 30. The tweeter unit 30 has a central opening 32 for that purpose. The tweeter unit 30 also has a plurality of legs 33 and openings 31.

FIG. 5 shows a diagrammatic plan view of a loudspeaker unit in accordance with the first embodiment. The tweeter horn 30 has openings 31 and legs 33 at the edge. To define the areas 300 of the recesses with respect to a comparative area or reference area 400, the Figure shows an inner circle 100 which with its periphery 100 adjoins the lower ends of the openings 31, that is to say the inside diameter of the reference area is defined by the depth of the openings. In addition there can be provided an outer circle 200 for delimiting the reference area, which corresponds to the outside diameter of the legs 33, that is to say the outside diameter of the reference area. The outer circle 200 corresponds to the circumference of the tweeter horn 30. The ratio between the area 300 of the openings 31 with respect to the reference area 400 between the inside and outside diameters 100, 200 is between 30% and 70%, in particular between 40% and 50% and is preferably 46%. In other words the tweeter horn 30 is of an inside diameter 100 defined by the depth of the openings 31. The tweeter horn 30 is further of an outside diameter 200 which is defined by the length of the legs 33. In this case a reference area 400 represents the area between the inside diameter 100 and the outside diameter 200.

The configuration of the tweeter unit with the tweeter horn is advantageous because in that way it is possible to achieve a wider sound emission angle with low levels of interference between the woofer unit and the tweeter unit.

As shown in FIG. 4 a spacer unit 40 for receiving the tweeter unit 30 is disposed in front of the woofer unit 10 so that the tweeter unit 30 is provided behind the woofer unit 10 in the sound issue direction. The cross-section of the free end of the tweeter unit 30 is greater than the cross-section of the free end of the woofer unit 10. In other words the area of the tweeter unit 30 is greater than the area of the woofer unit 10. In addition a tweeter 45 can be arranged in front of the woofer unit 10, that is to say the tweeter 45 is arranged in front of the woofer unit in opposite relationship to the sound issue direction.

The invention claimed is:

1. A loudspeaker unit, in particular a ceiling loudspeaker unit, comprising:

a housing having a first housing portion, wherein provided in the first housing portion are a woofer unit, a baffle panel and a tweeter unit in a 2-way coaxial system, wherein the tweeter unit has a tweeter horn with a plurality of legs and a plurality of openings at the edge of the tweeter horn, wherein the woofer unit and the tweeter unit are arranged in the baffle panel in sunk relationship, wherein the proportion of the areas of the openings with respect to a reference area is between 30% and 70%, wherein the reference area is defined by an inside diameter and an outside diameter of the tweeter horn, wherein the inside diameter of the tweeter horn is defined by the depth of the openings, and wherein the outside diameter of the tweeter horn is defined by the free-standing ends of the legs.

2. A loudspeaker unit as set forth in claim 1 wherein the legs of the tweeter unit extend to the edge of the baffle panel.

3. A loudspeaker unit as set forth in claim 1 wherein the cross-section of the tweeter unit is greater than the cross-section of the woofer unit.

4. A loudspeaker unit as set forth in claim 1 wherein a tweeter is arranged in front of the woofer unit.

5. A loudspeaker unit as set forth in claim 1 wherein the proportion of the areas of the openings with respect to a reference area is between 40% and 50%.

* * * * *

UNITED STATES PATENT AND TRADEMARK OFFICE

CERTIFICATE OF CORRECTION

PATENT NO. : 8,503,690 B2
APPLICATION NO. : 12/620193
DATED : August 6, 2013
INVENTOR(S) : Knieschewski It is certified that error appears in the above-identified patent and that said Letters Patent is hereby corrected as shown below:

In the Specification:

In column 1, line 9, delete "which is" and insert --which are--.

In column 1, line 15, add a "," after "loudspeakers".

In column 1, line 16 add a "," after "however".

In column 1, line 17, replace "range" with --ranges--.

In column 1, line 29, add a "," after "and".

In column 1, line 29, add a "," after "respect".

In column 1, line 33, add a "," after "Thus".

In column 1, line 33, add a "," after "particular".

In column 1, line 34, delete the "," after "unit".

In column 1, line 39, add a "," after "invention".

In column 1, line 41, add a "," before and after "in particular".

In column 1, line 50, add a "," after "invention".

In column 1, line 56, delete "means" and insert --ensure--.

In column 1, line 57, add a "," after "unit".

In column 1, line 58, add a "," after "unit".

In column 2, line 14, add a "," after "case".

Signed and Sealed this
Seventeenth Day of December, 2013

Margaret A. Focarino

Margaret A. Focarino
*Commissioner for Patents of the United States Patent and Trademark Office*

In column 2, line 20, add a “,” after “clear”.

In column 2, line 20, delete “, 45”.

In column 2, line 22, add a “,” after “case”.

In column 2, line 36, add a “,” before and after “for example”.

In column 3, line 1, delete “300” after “areas”.

In column 3, line 3, add a “,” before and after “with its periphery 100”.

In column 3, line 5, add a “,” after “In addition”.

In column 3, line 10, delete “300” after “area”.

In column 3, line 14, add a “,” after “words”.

In column 3, line 17, add a “,” after “case”.

In column 3, line 22, add a “,” before and after “in the way”.

In column 3, line 25, add a “,” after “FIG. 4”.

In column 3, line 30, add a “,” after “words”.

In column 3, line 32, add a “,” after “In addition”.